United States Patent [19]

Breen

[11] Patent Number: 4,483,039

[45] Date of Patent: Nov. 20, 1984

[54] SHOE SUPPORT APPARATUS

[76] Inventor: Cydney E. Breen, 20223 Chapter Dr., Woodland Hills, Calif. 91364

[21] Appl. No.: 537,427

[22] Filed: Sep. 29, 1983

[51] Int. Cl.[3] ..... A47L 23/18

[52] U.S. Cl. ..... 15/268; 12/123; 15/267

[58] Field of Search ..... 15/265, 266, 267, 268; 12/123, 124

[56] References Cited

U.S. PATENT DOCUMENTS

| | | | |
|---|---|---|---|
| 632,776 | 9/1899 | Brooks | 15/265 X |
| 2,459,310 | 1/1949 | Crow | 15/267 X |
| 2,967,312 | 1/1961 | Drew | 15/267 X |
| 3,641,617 | 2/1972 | Lopez | 15/267 |
| 4,109,335 | 8/1978 | Randolph | 12/123 |

*Primary Examiner*—Chris K. Moore

*Attorney, Agent, or Firm*—Pretty, Schroeder, Brueggemann & Clark

[57] ABSTRACT

A shoe support apparatus, particularly for supporting a shoe for cleaning and shining, in the form of a base plate that is designed for temporary mounting to a conventional door and that has an outwardly extending shoe support means which comprises a heel support and a spring-loaded adjustable toe support that is connected thereto in a manner permitting a slight amount of rocking motion of the toe support. For door mounting, the base plate has a tapered opening so that it can be received over a doorknob and hung from the doorknob stem, and further has clamping means for clamping the base plate securely to the door edge adjacent the doorknob. The apparatus may be partially collapsed and totally removed from the door for portability and storage.

19 Claims, 4 Drawing Figures

SHOE SUPPORT APPARATUS

BACKGROUND OF THE INVENTION

This invention relates generally to shoe support apparatus and, more particularly, to an improved shoe mount and support apparatus on which a shoe can be held for cleaning and shining.

For the well-dressed man or woman, cleaned and polished shoes are a required and necessary part of the wardrobe. In order for such persons to keep their shoes in an acceptable condition, they are typically required to regularly inspect and maintain the same. Unless the wearer can afford to pay another person to clean and shine his shoes, he must handle the task himself and it can be a very time consuming, inconvenient and messy job.

Since cleaning and shining shoes while wearing them is often an uncomfortable task, and for some persons even impossible, a device upon which shoes can be mounted conveniently for polishing is desirable. Previously devised apparatus intended to ease and simplify the shoe cleaning and shining process have ranged from nothing more than simple, static shoe trees to large, complicated and expensive power driven devices. Two such devices, by way of example, can be found in U.S. Pat. Nos. 3,641,617 and 4,109,335.

Although these prior apparatus have performed generally satisfactorily for their particular designs, a number of problems exist. For example, a problem of widespread concern to potential manufacturers and merchants of shoe shine apparatus of the larger, power-driven variety is the limited marketability of such expensive and complicated devices. It is generally recognized that consumers of this particular type of product have no desire to spend large sums of money for a device which will require anything more than a minimal effort to learn how to use effectively, nor are they willing to invest in a device which does not lend itself to convenient, out of the way storage.

Existing devices of simpler and more economical design generally have other shortcomings. Typically they are not designed to hold a shoe independent of the user so that both hands are free to perform a thorough cleaning and high-gloss polishing job. It will be appreciated that having both hands free is particularly required for proper use of a traditional polishing rag. Such devices also are not designed to support the shoe in a convenient mid-height location to eliminate bending and stooping. Further, they usually cannot accomodate a wide range of shoe sizes from children's shoes to the larger adult sizes.

Thus, there has remained a need for an improved, simplified and inexpensive shoe support apparatus that is lightweight, rugged, compact and portable and that will adequately and independently support a wide range of shoe sizes and make the shoeshine or cleaning operation more convenient. The present invention clearly fulfills these needs.

SUMMARY OF THE INVENTION

Briefly, and in general terms, the present invention provides a unique and compact shoe support apparatus for supporting and holding a shoe at a convenient mid-height position and in a secure manner that frees both hands of the user for cleaning and polishing, thereby yielding a significantly more convenient and less messy polishing job.

Basically, the apparatus of the invention includes a mounting base plate for attachment to a door, wall or other suitable fixed structure, and shoe support and holding means, including a heel support and toe support, that extend generally perpendicularly outwardly from the base plate. The heel support is configured to securely hold the back portion of a shoe in place through the combined effects of the downward force of gravity and a grip developed between the inside of the heel portion of the shoe and the heel support. The toe support is adjustable in length to accomodate a wide range of shoe sizes and is spring-loaded to set up a tension that both stretches the shoe slightly and helps hold it in place on the apparatus. The toe support furthermore is connected to the heel support structure by means that allow at least a limited amount of rotation of the toe support to permit a rocking motion that is compatible with the action of a polishing brush or rag to enhance the polish job and that helps prevent excess force from being applied to the apparatus. The mounting base can be such as to allow the owner to permanently mount the apparatus on any desirable surface, or it can be provided with means to temporarily mount the apparatus on a door while performing the cleaning and shining operation.

More specifically, the heel support is defined by an upper portion that is rigidly connected to the base plate and a lower portion that holds the heel of a shoe by means of an inclined rear surface disposed in confronting spaced relation to the base plate and over which the heel portion of the shoe is received, this rear surface having squared-off corner edges that engage and grip the inside heel portion of the shoe. The heel support preferably is made of wood and its inclined surface is flat for simplified manufacture by means of simple saw cuts, rather than the more expensive shaping operation that would be required for a curved heel support. The rotatable toe support includes a toe plate against which the leather of the toe portion of the shoe may be pressed and stretched to provide a suitable polishing surface and a toe support shaft which interconnects the toe plate to the heel support structure. The toe support shaft has one end placed within a bore in the heel support structure in such a manner so as to allow it to rock from side to side in response to the polishing action of a brush or rag, and a compression spring is disposed in the bore to provide the desired spring-loading of the toe support.

In the presently preferred embodiment, the opposite end of the toe support shaft is received similarly in a bore in the toe plate, with a second compression spring also disposed in that bore. With both springs in place the apparatus accomodates a range of adult size shoes, and at least one of the springs is removable to effectively shorten the toe support shaft and thereby accomodate a smaller shoe size range. Alternatively, a separate removeable plug that is receivable within one of the bores can be provided for lengthening or shortening the effective length of the toe support shaft as needed. For storage purposes, the toe support shaft and toe plate are removable and a bracket is provided on the face of the mounting base wherein the toe support shaft and toe plate may be inserted while not in use, thereby facilitating compactness.

In the preferred embodiment of the invention, the mounting base plate is provided with a generally egg-shaped or tapered opening through which a doorknob is accepted so that the stem of the doorknob acts as the primary vertical support for the apparatus. The base plate also is provided with a C-shaped bracket to clamp around the door edge generally adjacent the doorknob to secure the apparatus to the door. A plurality of spacers can be provided on the backside of the base plate to space it sufficiently from the door to avoid interference with any escutcheon plate surrounding the doorknob, with the spacers padded to prevent marring the door. The spacers are removeable so that substitute spacers of different height can be inserted to accomodate doors of different width.

It will be appreciated from the foregoing that the present invention represents an advance in the shoe-shine apparatus field. The apparatus is adapted to securely support a shoe in a manner facilitating improved cleaning and shining at a convenient mid-height location that eliminates stooping and frees both hands for work. The apparatus may be conveniently stored out of sight and retrieved only when needed, requiring only a door with a doorknob for effective utilization. No unsightly permanent mounts or brackets are required in order to use the device. Due to the simplicity of the design, manufacturing costs may be kept at a reasonable level, thereby improving the marketability of a product based on this design.

Other features and advantages of the present invention will become apparent from the following more detailed description, taken in conjunction with the accompanying drawings which illustrate, by way of example, the principals of the invention.

DETAILED DESCRIPTION OF THE PREFERRED EMBODIMENT

Figure 1:
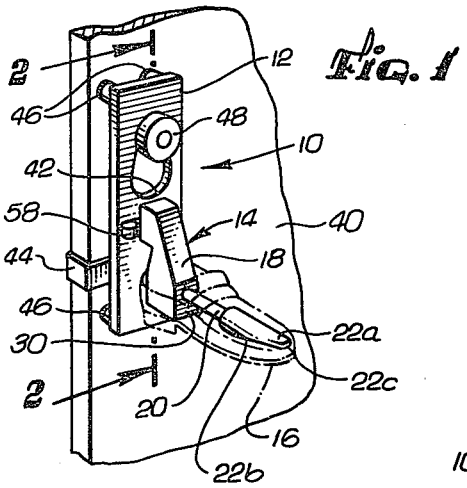
FIG. 1 is a perspective view depicting a preferred embodiment of a shoe support apparatus in accordance with the present invention, with the apparatus mounted on a door and a shoe shown in phantom for purposes of illustration.

Referring now to the drawings for the purpose of illustrating a presently preferred embodiment of the invention, and particularly to FIG. 1 thereof, there is shown a shoe support apparatus, indicated generally by reference numeral 10, constructed in accordance with the present invention. The shoe support apparatus 10 consists generally of a base plate 12, and a shoe support means, indicated generally by reference numeral 14, upon which a shoe 16 is placed so that it may be easily and efficiently cleaned and shined.

Figure 2:
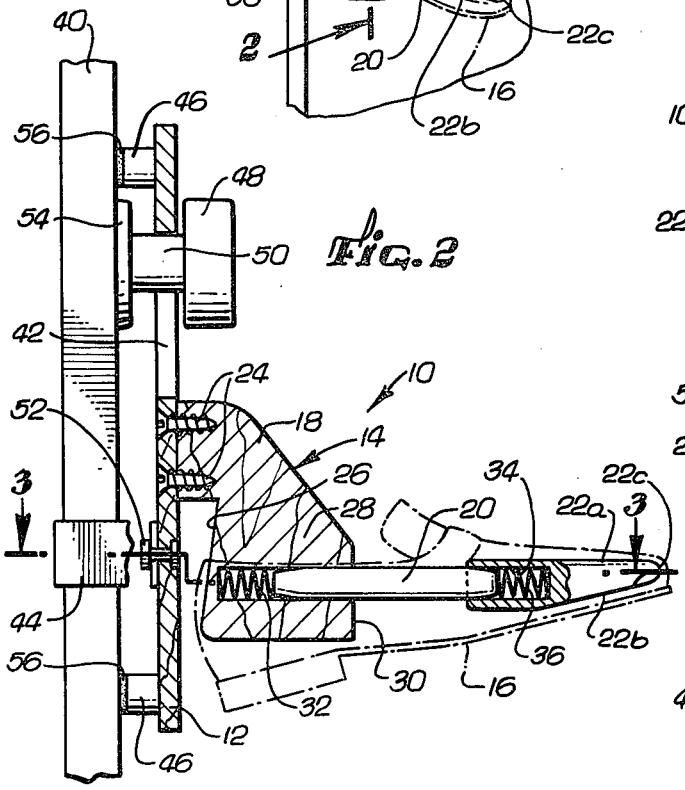
FIG. 2 is a fragmentary sectional view taken along the line 2—2 in FIG. 1.

The shoe support means 14 includes a heel support 18 and a toe support having a toe support shaft 20 and a toe plate 22. Referring to FIG. 2, the heel support 18 is essentially a block that is rigidly affixed to the base plate 12, as by screws 24, and has a portion adjacent the base plate that is cut away to form a rearward inclined surface 26 in confronting spaced relation to the base plate. A bore 28 is formed in the opposite, forwardly facing surface 30 of the heel support 18, into which one end of the toe support shaft 20 is received, with the toe plate 22 carried on the opposite end of the toe support shaft.

The toe support shaft 20 is received in the bore 28 snuggly, yet in a manner that allows the shaft to be rotated about its longitudinal axis. The toe support shaft 20 can be received similarly in a bore 34 in the toe plate 22 so that the toe plate also is allowed to rotate relative to the shaft. Because the toe support shaft 20 is allowed to rotate relative to the heel support 18 and the toe plate 22, the shoe 16 is permitted a limited side-to-side rocking motion compatible with the polishing action of a brush or rag. Desirably, this helps prevent excess torque generated by the cleaning and polishing operation from being applied to the heel support 18, and also enhances cleaning and polishing.

The toe plate 22 is in the general form of the lower half of a semi-cylinder having a smooth and gently curved upper surface **22*a*, upon which the toe portion of the shoe may be pressed and stretched to obtain a high gloss shine, and having a beveled lower surface such that the toe plate tapers toward its leading end 22*c* so that the shoe 16 may be easily received over the toe plate without binding. The toe plate 22 is sized to fill the toe portion of a shoe and its leading end 22*c*** is rounded along all edges to help conform to the curvature of the toe portion of a shoe.

A compression spring 32 is located within the bore 28 to spring load the toe support shaft 20 so that the shoe support means 14 can hold the shoe 16 in place by spring tension and can automatically accomodate differing shoe sizes within a range. A like compression spring 36 also can be located within the bore in the toe plate. Either of the compession springs 32 and 36 can be removed so that the shoe support means can be down sized to accommodate shoes of substantially smaller size range, such as children's shoes. Alternatively, the toe plate 22 can be rigidly attached to the toe support shaft 20, and plugs could be provided that could be easily inserted and removed from the bore 28 of the heel support 18 to effectively lengthen or shorten the toe support shaft as needed to change shoe size ranges.

Figure 3:
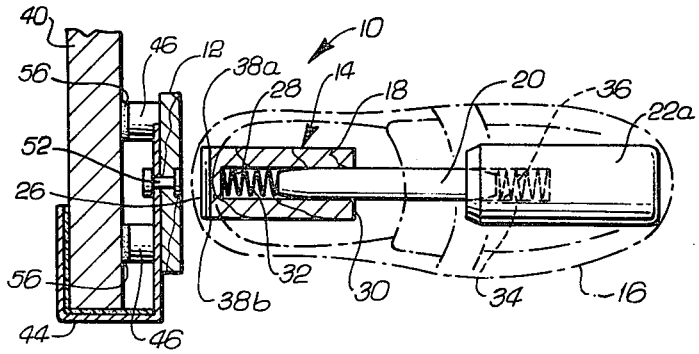
FIG. 3 is a fragmentary sectional view taken along the line 3—3 in FIG. 2.

To more securely hold the shoe 16 in place, the inclined rear surface 26 of the heel support 18 forming the heel receptacle is cut at a reverse angle so as to define an inclined surface with squared corner edges **38*a*, *b*, as best seen in FIG. 3. With this configuration, the lowermost portion of the heel support 18 extends furthest rearwardly so that, in conjunction with the spring tension provided by the compression springs 32 and 36, the shoe is held against the downward pull of gravity. Moreover, the squared off corner edges 38*a*, *b* tend to have a gripping effect on the inside heel portion of the shoe 16** to hold the shoe in place. This simple combination of features has been found to provide adequate support for the heel portion of the shoe, yet provides economies of manufacture in contrast to a more expensive design in which the heel support is conformed to the curved shape of the shoe.

The preferred embodiment of the shoe support apparatus 10 of the present invention is designed to be portable so that the apparatus may be conveniently stored out of sight and retrieved only when needed. More specifically, the apparatus is particularly adapted for temporary mounting on a door 40 by means of an opening 42 formed through the base plate 12 above the shoe support means 14, a clamp 44, and a plurality of base support spacers 46 mounted on the side of the base plate facing the door. The opening 42 is generally egg-shaped or tapered toward the top so that a doorknob 48 can be received through the enlarged lower portion of the opening, and the base plate 12 can then be allowed to rest on the stem 50 of the doorknob in the tapered portion of the opening. Preferably the main components of the apparatus, including the base plate 12, the heel support 18, the toe support shaft 20 and the toe plate 22, are formed of wood.

The clamp 44 is generally C-shaped and is mounted to the base plate 12 by a pin 52 that permits the clamp to rotate. The clamp 44, which is formed of any suitable metal, is configured such that it can be rotated to be received over and grip the edge of the door 40 when the base plate 12 is hung from the doorknob stem 50. The base support spacers 46 are provided to space the base plate 12 away from the door 40 to avoid interference with the escutcheon plate 54 that typically is part of doorknob assemblies, and to avoid marring the door. In this regard, the mouth of the clamp 44 and the height of the spacers are selected to provide a snug clamping action around the edge of the door. The base support spacers 46 are press fit into recesses in the base plate 12 so that they may be removed and replaced by spacers of different height to accommodate different width doors. It will be appreciated that doors come in standard widths, usually 1¾ inches or 1¼ inches depending on whether they are commercial or residential doors, so that two sets of spacers will accommodate most applications. Ideally the free ends of the spacers 46 are cushioned by felt liners 56 to further protect the surface of the door from marring.

Figure 4:
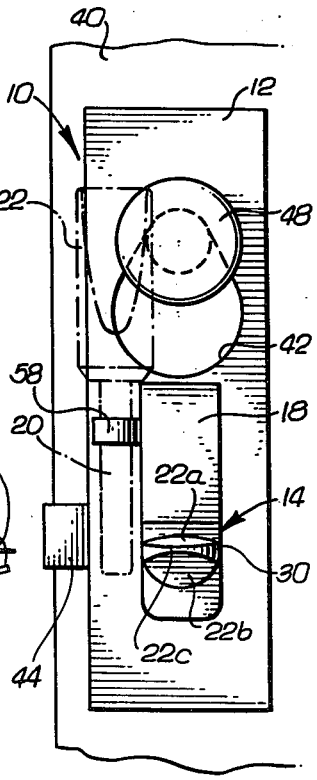
FIG. 4 is a front elevational view of the shoe support apparatus depicted in FIG. 1, and illustrates storage of the toe support in phantom.

In order to attach the apparatus 10 to the door 40, all that is required is that the doorknob 48 be slipped through the lower enlarged portion of the opening 42, thereafter allowing the base plate 12 to rest upon the stem 50 of the doorknob in the upper and narrower portion of the opening (FIG. 4). Clamping of the apparatus 10 to the door 40 is accomplished by rotating the entire apparatus about the door knob toward the edge of the door, aligning the clamp 44 so that it may accept a portion of the door edge, and then rotating the apparatus into its intended vertical position with the clamp over the edge of the door.

With the shoe shine apparatus 10 appropriately mounted to the door 40, a shoe 16 may be supported thereon by first slipping the toe plate 22 into the interior toe portion of the shoe and then simply by slipping the heel portion of the shoe over the heel support 18. The compression springs 32 and 36 allow the apparatus to adjust automatically to the size of the shoe supported on the apparatus 10. The shoe is then firmly supported and conveniently disposed at mid-height to allow all of the exterior surfaces to be easily cleaned and polished without bending or stooping. Once the shoe shine operation is complete, the shoe may be removed from the apparatus in essentially the reverse order in which it was placed thereon.

The apparatus 10 may then be removed from the door 40 by rotating the base plate 12 away from the edge of the door about the doorknob 48 until the clamp 44 releases from the edge of the door. With the clamp 44 clear of the door 40, the base plate 12 may be lifted and withdrawn over the doorknob 48, thereby completely removing the apparatus 10 from the door. As shown by FIG. 4, for compactness the toe support shaft 20 and toe plate 22 may be removed from the heel support 18 and placed within a storage ring 58 provided on the face of the base plate 12, and the clamp 44 may be rotated about its pin 52 so that the clamp does not project beyond the base plate 12. The entire apparatus may then be stored out of sight until once again needed.

The shoe support apparatus of the present invention provides an improvement over existing shoe shine devices in terms of simplicity, cost of manufacture, compactness and effectiveness. The apparatus is capable of securely supporting a shoe in a convenient position for cleaning and shining and provides an excellent means whereby a high gloss shoe shine may be obtained.

Although a particular embodiment of the invention has been described in detail for purposes of illustration, various modifications may be made without departing from the spirit and scope of the invention. Accordingly, the invention is not to be limited, except by the appended claims.

I claim:

1. A shoe support apparatus, comprising:

a base plate;

means carried by said base plate for supporting a shoe in an outwardly extending position generally perpendicular to said base plate; and means for releasably mounting said base plate on a door, said means including means defining an opening in said base plate through which a doorknob is receivable for suspending said base plate therefrom, and clamping means carried by said base plate for securing said base plate to the edge of the door generally adjacent the doorknob.

2. A shoe support apparatus as set forth in claim 1, wherein said opening defining means comprises a generally egg-shaped opening having an enlarged lower portion for receiving the doorknob and a tapered upper portion into which a doorknob stem is received.

3. A shoe support apparatus as set forth in claim 1, wherein said clamping means comprises a generally C-shaped clamp receivable over the edge of the door adjacent the doorknob.

4. A shoe support apparatus as set forth in claim 3, wherein said releasable mounting means further includes:

means for spacing said base plate from the door.

5. A shoe support apparatus, comprising:

a base plate including means for mounting to a fixed mounting structure;

heel support means for receiving and retaining a heel portion of a shoe, said heel support means connected to said base plate;

toe support means for receiving a toe portion of the shoe and for providing a surface against which the toe portion of the shoe may be stretched and pressed when cleaning and polishing; and connecting means for interconnecting said toe support means to said heel support means in spaced relation, said connecting means including a toe support shaft extending from said heel support means to said toe support means in generally perpendicular relation to said base plate, said toe support shaft capable of at least limited rotational movement about its longitudinal axis so as to permit rocking motion of said toe support means, and means for spring-loading said toe support shaft along its longitudinal axis.

6. A shoe support apparatus as set forth in claim 5, wherein said heel support means comprises a block having an upper mounting portion affixed to said base plate and a lower heel retaining portion, said heel retaining portion including a rear surface disposed in confronting spaced relationship to said base plate, said rear surface having an incline shaft such that the bottom part of said heel retaining portion extends furthest rearwardly, and said rear surface further having corner side edges to engage and grip the inside heel portion of the shoe.

7. A shoe support apparatus as set forth in claim 5, wherein said toe support shaft is received within a complementary bore in said heel support means such that said toe support shaft is capable of at least limited relative rotation about its longitudinal axis, and further wherein said spring-loading means comprises a compression spring disposed within said bore.

8. A shoe support apparatus as set forth in claim 7, wherein said toe support shaft is removable from said bore in said heel support means.

9. A shoe support apparatus as set forth in claim 5, wherein said connecting means includes means for adjusting the distance separating said toe support means and said heel support means.

10. A shoe support apparatus as set forth in claim 5, wherein said toe support shaft is received within a complementary bore in said toe plate such that said toe plate is capable of at least limited relative rotation, and further wherein said spring-loading means includes a removable compression spring disposed within said bore.

11. A shoe support apparatus, comprising:

a base plate;

means for releasably mounting said base plate on a door, said means including means defining an opening in said base plate through which a doorknob is receivable for suspending said base plate therefrom, and clamping means carried by said base plate for securing said base plate to the edge of the door generally adjacent the doorknob;

heel support means for receiving and retaining a heel portion of a shoe, said heel support means connected to said base plate;

toe support means for receiving a toe portion of the shoe and for providing a surface against which the toe portion of the shoe may be stretched and pressed when cleaning and polishing; and connecting means for interconnecting said toe support means to said heel support means, said connecting means including a toe support shaft extending from said heel support means to said toe support means in generally perpendicular relation to said base plate, said toe support shaft capable of at least limited rotational movement about its longitudinal axis, and means for spring-loading said toe support shaft along its longitudinal axis.

12. A shoe support apparatus as set forth in claim 11, wherein said opening defining means comprises a generally egg-shaped opening having an enlarged lower portion for receiving the doorknob and a tapered upper portion into which a doorknob stem is received, and wherein said clamping means comprises a generally C-shaped clamp receivable over the edge of the door adjacent the doorknob.

13. A shoe support apparatus as set forth in claim 12, wherein said releasable mounting means further includes:

means for spacing said base plate from the door.

14. A shoe support apparatus as set forth in claim 11, wherein said toe support shaft is received within a complementary bore in said heel support means such that said toe support shaft is capable of at least limited relative rotation about its longitudinal axis, and further wherein said spring-loading means comprises a compression spring disposed within said bore.

15. A shoe support apparatus as set forth in claim 11, wherein said toe support shaft is removable from said bore in said heel support means.

16. A shoe support apparatus as set forth in claim 11, wherein said toe support shaft is received within a complementary bore in said toe plate such that said toe plate is capable of at least limited relative rotation, and further wherein said spring-loading means includes a removable compression spring disposed within said bore.

17. A shoe support apparatus, comprising:

a base plate;

means for releasably mounting said base plate on a door, said means including an opening in said base plate through which a doorknob is receivable for suspending said base plate therefrom, and a C-shaped clamp pivotally mounted to said base plate for securing said base plate to the edge of the door generally adjacent the doorknob;

a heel support block having an upper mounting portion affixed to said base plate and a lower heel retaining portion, said heel retaining portion including a generally flat rear surface disposed in confronting spaced relationship to said base plate, said rear surface having an incline relative to said longitudinal axis of said toe support shaft such that the bottom part of said heel retaining portion extends furthest rearwardly, and said rear surface further having corner side edges to engage and grip the inside heel portion of the shoe;

a toe plate having a surface against which the toe portion of the shoe may be stretched and pressed when cleaning and polishing; and a toe support shaft interconnecting said heel support block to said toe support plate, said toe support shaft extending in generally perpendicular relation to said base plate, said toe support shaft capable of at least limited rotational movement about its longitudinal axis; and means for spring-loading said toe support shaft along its longitudinal axis.

18. A shoe support apparatus as set forth in claim 17, wherein said toe support shaft is received within a complementary bore in said heel support block such that said toe support shaft is capable of at least limited relative rotation about its longitudinal axis, and further wherein said spring-loading means comprises a compression spring disposed within said bore.

19. A shoe support apparatus as set forth in claim 18, wherein said toe support shaft is removable from said bore in said heel support block.

* * * * *